US010821499B2

(12) United States Patent
Auxier

(10) Patent No.: US 10,821,499 B2
(45) Date of Patent: Nov. 3, 2020

(54) CONSTRUCTION OF MULTI-LAYERED REFRACTORY METAL CORE FOR INVESTMENT CASTING

(71) Applicant: United Technologies Corporation, Farmington, CT (US)

(72) Inventor: James Tilsley Auxier, Bloomfield, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 351 days.

(21) Appl. No.: 15/897,312

(22) Filed: Feb. 15, 2018

(65) Prior Publication Data

US 2019/0247914 A1 Aug. 15, 2019

(51) Int. Cl.

| | |
|---|---|
| ***B22C 9/10*** | (2006.01) |
| ***B22F 5/00*** | (2006.01) |
| ***B22C 9/12*** | (2006.01) |
| ***B22C 9/22*** | (2006.01) |
| ***B22C 3/00*** | (2006.01) |
| ***B22F 7/08*** | (2006.01) |

(52) U.S. Cl.

CPC ..... *B22C 9/10* (2013.01); *B22C 3/00* (2013.01); *B22C 9/103* (2013.01); *B22C 9/12* (2013.01); *B22C 9/22* (2013.01); *B22F 5/007* (2013.01); *B22F 7/08* (2013.01)

(58) Field of Classification Search

CPC .... B22C 9/10; B22C 9/12; B22C 9/22; B22C 9/103; B22C 9/108

See application file for complete search history.

(56) References Cited

U.S. PATENT DOCUMENTS

| | | | |
|---|---|---|---|
| 7,686,065 | B2 | 3/2010 | Luczak |
| 9,243,502 | B2 | 1/2016 | Ku |
| 9,296,039 | B2 | 3/2016 | Propheter-Hinckley et al. |
| 2013/0280081 | A1 | 10/2013 | Propheter-Hinckley et al. |
| 2014/0102656 | A1 | 4/2014 | Propheter-Hinckley et al. |
| 2015/0251242 | A1 | 9/2015 | Propheter-Hinckley et al. |

FOREIGN PATENT DOCUMENTS

WO 2009143173 A2 11/2009

OTHER PUBLICATIONS

European Search Report dated Apr. 30, 2019 for corresponding European Patent Application No. 19157502.6.

*Primary Examiner* — Kevin P Kerns
*Assistant Examiner* — Steven S Ha
(74) *Attorney, Agent, or Firm* — Bachman & LaPointe, P.C.

(57) ABSTRACT

A refractory metal core laminate assembly, comprising: a first refractory metal core layer having exterior surfaces and a first side and a second side opposite the first side; a second refractory metal core layer having exterior surfaces and a first side and a second side opposite the first side, the second refractory metal core layer being arranged above the first refractory metal core layer with the second refractory metal core layer first side facing the first refractory metal core layer second side; a layer of a powder bed material between the first refractory metal core layer second side and the second refractory metal core layer first side; and a coating of the powder bed material coupled to the first refractory metal core layer exterior surfaces and the second refractory metal core layer exterior surfaces.

13 Claims, 2 Drawing Sheets

CONSTRUCTION OF MULTI-LAYERED REFRACTORY METAL CORE FOR INVESTMENT CASTING

BACKGROUND

The disclosure relates to a process for combining multiple refractory metal cores (RMC) stacked upon each other during a coating process to create thicker more complex shapes. The refractory metal core layers can be stacked during coating, such as during a powder bed coating process. The stacked structure combined during coating results in a more sturdy structure for casting.

Current production methods for refractory metal cores includes rolling an ingot of pre-sintered molybdenum alloy into progressively thinner flat sheets, then cutting and/or stamping patterns out of these sheets. The flat patterns are then formed and coated in order to protect them from alloying during casting. The refractory metal cores can be ready for assembly into a wax pattern. One issue with the current process is that only certain thicknesses of molybdenum sheets are readily available from the supplier, and then only in a monolithic flat form. A second issue is that forming the flat pattern into shapes performed by bending on a press is unreliable in terms of resultant shape variability. The variability of the shape currently renders usage of highly non-flat RMCs in the casting process unusable in production.

SUMMARY

In accordance with the present disclosure, there is provided a refractory metal core laminate assembly, comprising: a first refractory metal core layer having exterior surfaces and a first side and a second side opposite the first side; a second refractory metal core layer having exterior surfaces and a first side and a second side opposite the first side, the second refractory metal core layer being arranged above the first refractory metal core layer with the second refractory metal core layer first side facing the first refractory metal core layer second side; a layer of a powder bed material between the first refractory metal core layer second side and the second refractory metal core layer first side; and a coating of the powder bed material coupled to the first refractory metal core layer exterior surfaces and the second refractory metal core layer exterior surfaces.

In another and alternative embodiment, the laminate structure further comprises at least one additional refractory metal core layer having exterior surfaces and a first side and a second side opposite the first side, the additional refractory metal core layer being arranged above the second refractory metal core layer with the additional refractory metal core layer first side facing the second refractory metal core layer second side, the coating of the powder bed material coupled to the at least one additional refractory metal core exterior surfaces.

In another and alternative embodiment, each of the first refractory metal core and the second refractory metal core comprises a flat pattern.

In another and alternative embodiment, the coating of powder bed material is configured in a predetermined thickness.

In accordance with the present disclosure, there is provided a process of forming a laminate structure, comprising laying a first refractory metal core in a powder bed comprising powder bed material, the first refractory metal core having exterior surfaces, a first side and a second side opposite the first side, and being positioned with the first side on top of the powder bed material; depositing additional powder bed material over the first refractory metal core second side; laying a second refractory metal core over the first refractory metal core, the second refractory metal core having exterior surfaces, a first side and a second side opposite the first side, and being positioned with the first side on top of the first refractory metal core second side with powder bed material in between the first refractory metal core second side and the second refractory metal core first side; depositing additional powder bed material over the second refractory metal core second side and exterior surfaces; and fusing the powder bed material and the additional powder bed material.

In another and alternative embodiment, the process of forming a laminate structure further comprises prior to fusing the powder bed material, laying at least one additional refractory metal core having exterior surfaces, a first side and a second side opposite to the first side on top of the second refractory metal core with the additional refractory metal core first side facing the second refractory metal core second side; depositing additional powder bed material over the at least one additional refractory metal core second side and exterior surfaces; and fusing the powder bed material and the additional powder bed material.

In another and alternative embodiment, the process of forming a laminate structure further comprises before the laying steps, forming the first refractory metal core and the second refractory metal core into a predetermined pattern.

In another and alternative embodiment, the predetermined pattern comprises a flat pattern.

In another and alternative embodiment, the process of forming a laminate structure further comprises adding a binder to the powder bed material.

In another and alternative embodiment, the process of forming a laminate structure further comprises pre-assembling the first refractory metal core with the second refractory metal core prior to fusing the powder bed material.

In another and alternative embodiment, the process of forming a laminate structure further comprises forming a powder bed outer layer coating over the pre-assembled first refractory metal core and the second refractory metal core.

In another and alternative embodiment, the process of forming a laminate structure further comprises dipping the pre-assembled first refractory metal core and the second refractory metal core into a fluidized powder bed.

In another and alternative embodiment, the process of forming a laminate structure further comprises forming three-dimensional shapes from the laminate structure.

Other details of the refractory metal core laminate assembly and process are set forth in the following detailed description and the accompanying drawings wherein like reference numerals depict like elements.

DETAILED DESCRIPTION

Figure 1:
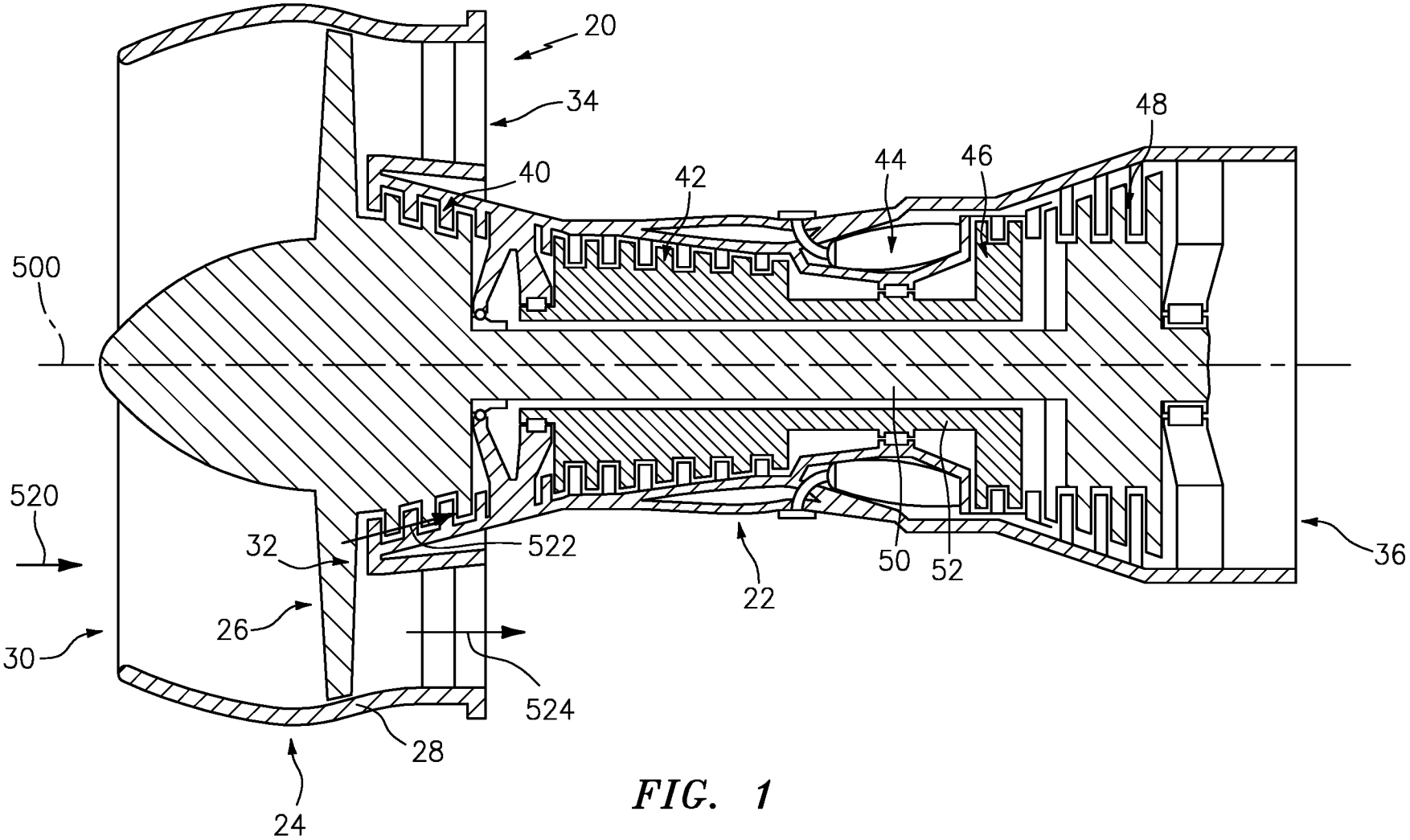
FIG. 1 is a schematic longitudinal sectional view of a turbofan engine.

FIG. 1 shows a gas turbine engine 20 having an engine case 22 surrounding a centerline or central longitudinal axis 500. An exemplary gas turbine engine is a turbofan engine having a fan section 24 including a fan 26 within a fan case 28. The exemplary engine includes an inlet 30 at an upstream end of the fan case receiving an inlet flow along an inlet flow path 520. The fan 26 has one or more stages of fan blades 32. Downstream of the fan blades, the flow path 520 splits into an inboard portion 522 being a core flow path and passing through a core of the engine and an outboard portion 524 being a bypass flow path exiting an outlet 34 of the fan case.

The core flow path 522 proceeds downstream to an engine outlet 36 through one or more compressor sections, a combustor, and one or more turbine sections. The exemplary engine has two axial compressor sections and two axial turbine sections, although other configurations are equally applicable. From upstream to downstream there is a low pressure compressor section (LPC) 40, a high pressure compressor section (HPC) 42, a combustor section 44, a high pressure turbine section (HPT) 46, and a low pressure turbine section (LPT) 48. Each of the LPC, HPC, HPT, and LPT comprises one or more stages of blades which may be interspersed with one or more stages of stator vanes.

In the exemplary engine, the blade stages of the LPC and LPT are part of a low pressure spool mounted for rotation about the axis 500. The exemplary low pressure spool includes a shaft (low pressure shaft) 50 which couples the blade stages of the LPT to those of the LPC and allows the LPT to drive rotation of the LPC. In the exemplary engine, the shaft 50 also directly drives the fan. In alternative implementations, the fan may be driven via a transmission (e.g., a fan gear drive system such as an epicyclical transmission) to allow the fan to rotate at a lower speed than the low pressure shaft.

The exemplary engine further includes a high pressure shaft 52 mounted for rotation about the axis 500 and coupling the blade stages of the HPT to those of the HPC to allow the HPT to drive rotation of the HPC. In the combustor 44, fuel is introduced to compressed air from the HPC and combusted to produce a high pressure gas which, in turn, is expanded in the turbine sections to extract energy and drive rotation of the respective turbine sections and their associated compressor sections (to provide the compressed air to the combustor) and fan.

Figure 2:
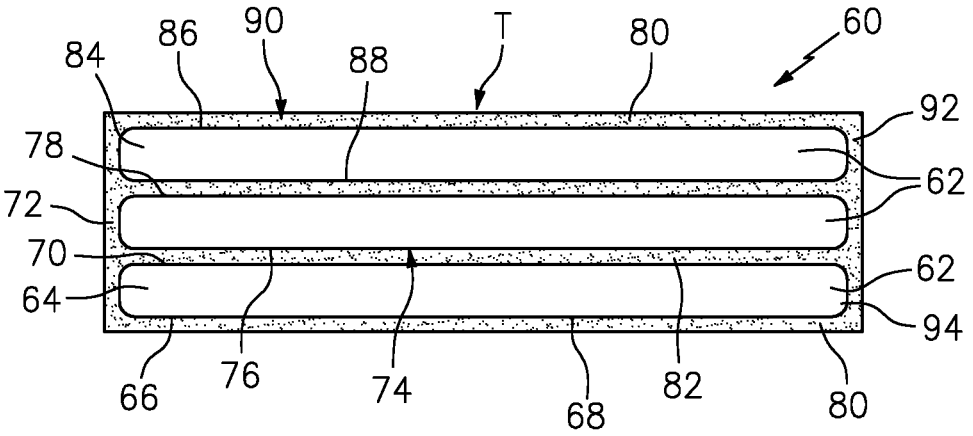
FIG. 2 is a schematic cross sectional view of an exemplary laminate refractory metal core coated assembly.

Referring to FIG. 2, a refractory metal core laminate assembly 60 is shown. The refractory metal core laminate assembly 60 includes a stack of refractory metal core plates 62 in layers. Exemplary refractory metal cores (RMCs) are refractory metal based (i.e., having substrates of at least fifty weight percent one or more refractory metals such as molybdenum, tungsten, niobium, or the like, optionally coated). A first refractory metal core layer 64 has exterior surfaces 66 and a first side 68 and a second side 70 opposite the first side 70.

A second refractory metal core layer 72 has exterior surfaces 74 and a first side 76 and a second side 78 opposite said first side 76. The second refractory metal core layer 72 is arranged above the first refractory metal core layer 64 with the second refractory metal core layer 72 first side 76 facing the first refractory metal core layer 64 second side 70.

A powder bed material 80 can be formed into a powder bed material layer 82 between the first refractory metal core layer 64 second side 70 and the second refractory metal core layer 72 first side 76.

A coating of the powder bed material 80 can be coupled to the first refractory metal core layer exterior surfaces 66 and the second refractory metal core layer exterior surfaces 74.

In an exemplary embodiment, the powder bed material 80 can comprise aluminide, aluminide-based powder and the like.

In an exemplary embodiment, the RMC laminate assembly 60 can include multiple layers of RMC and powder bed material 80. In an exemplary embodiment, at least one additional refractory metal core layer 84 that has exterior surfaces 86 and a first side 88 and a second side 90 opposite the first side 88. The additional refractory metal core layer 84 can be arranged above the second refractory metal core layer 72 with the additional refractory metal core layer first side 88 facing the second refractory metal core layer second side 78. A coating 92 of the powder bed material 80 can be coupled to the at least one additional refractory metal core exterior surface 86. The refractory metal core(s), 64 72, 84 may be coated with the coating 92 in order to isolate the RMC from the molten casting alloy (to protect the alloy) and prevent oxidation of the refractory metal components. An exemplary coating is an aluminide and/or aluminum oxide (e.g., a platinum aluminide applied via chemical vapor deposition (CVD)).

In an exemplary embodiment, each of the first refractory metal core 64 and the second refractory metal core 72 and additional refractory metal core 84 can include a flat pattern 92.

In another alternate embodiment, the multiple layers of refractory metal cores 64, 72, 84, can be formed into complex shapes. The exemplary RMC laminate assembly 60 can be configured to cast passageways and/or other features utilized in the final as-cast component. Each of the RMCs in the laminate assembly can include a plurality of apertures or other features of appropriate shape for casting post features in the associated component (not shown).

In an exemplary embodiment the coating 92 of powder bed material is configured in a predetermined thickness T.

Figure 3:
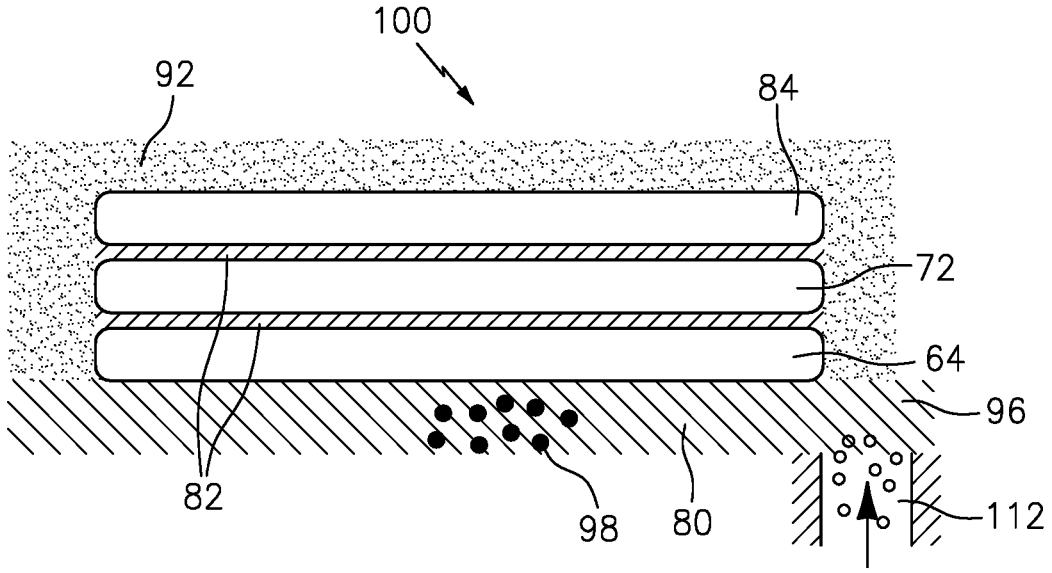
FIG. 3 is a schematic cross sectional view of an exemplary laminate refractory metal core stack process.

Referring also to FIG. 3 a process 100 of forming the laminate structure 60 described above is illustrated.

A powder bed material 80 is spread out in a predetermined thickness. The first refractory metal core 64 is laid in a powder bed 96 comprising the powder bed material 80. The first refractory metal core includes the exterior surfaces 66, the first side 68 and second side 70 opposite the first side 68. The first refractory metal core 64 is positioned with the first side 68 on top of the powder bed 96 made of the powder bed material 80.

Additional powder bed material 80 is deposited over the first refractory metal core second side 70.

The second refractory metal core 72 is laid over the first refractory metal core 64. The second refractory metal core includes exterior surfaces 74, the first side 76 and second side 78 opposite the first side 76. The second refractory metal core 72 is positioned with the first side 76 on top of the first refractory metal core second side 70 with powder bed material layer 82 in between the first refractory metal core second side 70 and the second refractory metal core first side 76.

Additional powder bed material 80 can be deposited over the second refractory metal core second side 78 and exterior surfaces 74.

In an exemplary embodiment, all of the powder bed material 80 can be fused. The refractory metal core laminate assembly 60 is formed together by the fusion of the powder bed material 80. In an exemplary embodiment, these steps can be repeated to form thicker more complex shapes, such as three-dimensional shapes.

In another exemplary embodiment, prior to fusing the powder bed material 80, at least one additional refractory metal core 84 having exterior surfaces 86, a first side 88 and a second side 90 opposite to the first side 88 is laid on top of the second refractory metal core 72 with the additional refractory metal core first side 88 facing the second refractory metal core second side 78.

Additional powder bed material 80 is deposited over the at least one additional refractory metal core second side 90 and exterior surfaces 86. All of the powder bed material 80 is fused to form the laminate assembly 60.

In an exemplary embodiment, a binder 98 can be added to the powder bed material 80. The binder 98 can help with pre-assembling the first refractory metal core 64 with the second refractory metal core 72 prior to fusing the powder bed material 80. The powder bed outer layer coating 92 can be formed over the pre-assembled first refractory metal core 64 and said second refractory metal core 72. In an alternative embodiment, the pre-assembled first refractory metal core 64 and said second refractory metal core 72 can be dipped into a fluidized powder bed 112 (shown schematically).

The refractory metal core laminate assembly and process achieves solid RMC thicknesses not readily produced from moly alloy suppliers, which are tooled to only produce certain stock sizes.

The refractory metal core laminate assembly and process achieves solid RMC thicknesses not possible from rolling, due to metallurgical limitations.

The refractory metal core laminate assembly and process can produce non-solid, cancellous RMC.

The refractory metal core laminate assembly and process achieves RMC shapes not possible from a single flat pattern, such as intersecting cores, film cooling holes, or varying cross-section.

The refractory metal core laminate assembly and process can produce positive or negative shapes without additional forming steps, such as trip strips that would have been formed through coining.

There has been provided a refractory metal core laminate assembly and process. While the refractory metal core laminate assembly and process has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A refractory metal core laminate assembly, comprising:

a first refractory metal core layer having exterior surfaces and a first side and a second side opposite said first side;

a second refractory metal core layer having exterior surfaces and a first side and a second side opposite said first side, said second refractory metal core layer being arranged above said first refractory metal core layer with said second refractory metal core layer first side facing said first refractory metal core layer second side;

a layer of a powder bed material between said first refractory metal core layer second side and said second refractory metal core layer first side; and a coating of said powder bed material coupled to said first refractory metal core layer exterior surfaces and said second refractory metal core layer exterior surfaces.

2. The refractory metal core laminate assembly of claim 1, further comprising:

at least one additional refractory metal core layer having exterior surfaces and a first side and a second side opposite said first side, said at least one additional refractory metal core layer being arranged above said second refractory metal core layer with said at least one additional refractory metal core layer first side facing said second refractory metal core layer second side, said coating of said powder bed material coupled to said at least one additional refractory metal core exterior surfaces.

3. The refractory metal core laminate assembly of claim 1, wherein each of said first refractory metal core and said second refractory metal core comprises a flat pattern.

4. The refractory metal core laminate assembly of claim 1, wherein said coating of powder bed material is configured in a predetermined thickness.

5. A process of forming a laminate structure, comprising laying a first refractory metal core in a powder bed comprising powder bed material, said first refractory metal core having exterior surfaces, a first side and a second side opposite said first side, and being positioned with said first side on top of said powder bed material;

depositing additional powder bed material over said first refractory metal core second side;

laying a second refractory metal core over said first refractory metal core, said second refractory metal core having exterior surfaces, a first side and a second side opposite said first side, and being positioned with said first side on top of said first refractory metal core second side with powder bed material in between said first refractory metal core second side and said second refractory metal core first side;

depositing additional powder bed material over said second refractory metal core second side and exterior surfaces; and fusing said powder bed material and said additional powder bed material.

6. The process of forming a laminate structure of claim 5 further comprising:

prior to fusing said powder bed material, laying at least one additional refractory metal core having exterior surfaces, a first side and a second side opposite to said first side on top of said second refractory metal core with said at least one additional refractory metal core first side facing said second refractory metal core second side;

depositing additional powder bed material over said at least one additional refractory metal core second side and exterior surfaces; and fusing said powder bed material and said additional powder bed material.

7. The process of forming a laminate structure of claim 5 further comprising, before said laying steps, forming said first refractory metal core and said second refractory metal core into a predetermined pattern.

8. The process of forming a laminate structure of claim 7, wherein said predetermined pattern comprises a flat pattern.

9. The process of forming a laminate structure of claim 5 further comprising:

adding a binder to said powder bed material.

10. The process of forming a laminate structure of claim 5 further comprising:

pre-assembling said first refractory metal core with said second refractory metal core prior to fusing said powder bed material.

11. The process of forming a laminate structure of claim 10 further comprising:

forming a powder bed outer layer coating over said pre-assembled first refractory metal core and said second refractory metal core.

12. The process of forming a laminate structure of claim 11 further comprising:

dipping said pre-assembled first refractory metal core and said second refractory metal core into a fluidized powder bed.

13. The process of forming a laminate structure of claim 5 further comprising:

forming three-dimensional shapes from said laminate structure.

* * * * *